US007370974B2

(12) United States Patent
Yamada et al.

(10) Patent No.: US 7,370,974 B2
(45) Date of Patent: May 13, 2008

(54) TOY WITH VIRTUAL CHARACTER

(75) Inventors: Satoshi Yamada, Tokyo (JP); Shigeru Kanauchi, Tokyo (JP)

(73) Assignee: Sega Toys, Ltd., Tokyo (JP)

( * ) Notice: Subject to any disclaimer, the term of this patent is extended or adjusted under 35 U.S.C. 154(b) by 272 days.

(21) Appl. No.: 11/255,991

(22) Filed: Oct. 24, 2005

(65) Prior Publication Data

US 2006/0160588 A1 Jul. 20, 2006

(30) Foreign Application Priority Data

Jan. 14, 2005 (JP) ..... 2005-008300

(51) Int. Cl.

| | |
|---|---|
| ***G03B 21/14*** | (2006.01) |
| ***A63J 19/00*** | (2006.01) |
| ***A63F 9/24*** | (2006.01) |
| ***G02F 1/1335*** | (2006.01) |

(52) U.S. Cl. ..... 353/28; 353/119; 353/122; 446/82; 463/1; 349/5

(58) Field of Classification Search ..... 353/10, 353/15, 19, 28, 30, 94, 119, 121, 122, 46, 353/79, 98, 99; 52/6, 7; 472/60, 61; 358/60; 352/40, 69, 88, 89; 446/75, 76, 476, 82; 348/36, 115, 744, 745; 359/451–459, 443; 349/451–459, 443; 463/1

See application file for complete search history.

(56) References Cited

U.S. PATENT DOCUMENTS

| | | | | |
|---|---|---|---|---|
| 5,261,849 | A * | 11/1993 | French | 446/82 |
| 6,644,816 | B1 * | 11/2003 | Perra et al. | 353/119 |
| 6,755,536 | B2 * | 6/2004 | Tegreene et al. | 353/94 |
| 7,097,307 | B2 * | 8/2006 | Lawrence | 353/28 |
| 2004/0203317 | A1 * | 10/2004 | Small | 446/476 |

FOREIGN PATENT DOCUMENTS

| | | |
|---|---|---|
| JP | A-10-232595 | 9/1998 |
| JP | A-2000-037568 | 2/2000 |
| JP | B2-3285827 | 3/2002 |

* cited by examiner

*Primary Examiner*—Melissa Jan Koval
(74) *Attorney, Agent, or Firm*—Oliff & Berridge, PLC

(57) ABSTRACT

The present invention provides a toy that makes character movement realistic, A transparent LCD screen that is visible from the front of the room is disposed within the room so as to be in contact with the walls, ceiling and floor thereof. An internal body such as a chair and an external body such as a tree, fence or kennel are arranged at the front and rear of the LCD screen. A girl character and an animal character are displayed on the LCD screen. A user is able to enjoy the game while viewing the character of the LCD screen, internal body, and external body.

9 Claims, 4 Drawing Sheets

TOY WITH VIRTUAL CHARACTER

BACKGROUND

The present invention relates to a toy that makes it possible to play with a character that is displayed on a screen in accordance with a game program.

Conventionally, house toys that make it possible to play dolls, for example, are known as toys that are constituted to cause a game to progress in accordance with a game program (see Japanese Patent No. 3285827 (pages 2 to 4, FIG. 1*a*). Such house toys have furniture such as a desk, bed, piano, or the like, and electronic components such as a telephone, microwave, electric light, or the like, provided in a main body together with signal production means for the sound, speech, and light and so forth corresponding with each electrical component. A switch for turning the signal production means ON or OFF is provided inside the electrical components or in the vicinity thereof. Further, in a process in which the game progresses in accordance with the game program, the player is provided with instructions by the signal production means and it is possible to judge whether the player has followed the instructions by sensing the ON or OFF of the switch. The house toy causes the game to progress in accordance with the game program and, therefore, various scenes can be provided in the main body of one house toy and the player can be provided with play that corresponds with each scene.

However, with these house toys, the player must play by directly holding the doll's body. A virtual life form nurturing simulation apparatus has been proposed (See Japanese Patent Application Laid Open No. H10-232595 (pages 5 to 7, pages 10 to 11, FIGS. 1 and 2) as an apparatus that makes it possible to play with a character while viewing a screen without directly holding the doll's body. With the virtual life form nurturing simulation apparatus, a virtual life form is displayed on a screen as a character and, as a result of the player responding to and dealing with the calls and requests and so forth from the virtual life form on the screen, the virtual life form can be allowed to grow while being disciplined and trained.

In the case of the virtual life form nurturing simulation apparatus, the virtual life form is displayed on the screen as a character and the player is able to play with the virtual life form while viewing the screen by responding to the calls and requests and so forth from the virtual life form on the screen.

However, even when the virtual life form is displayed on the screen, the movements of the virtual life form cannot be made adequately realistic.

SUMMARY

An object of the present invention is to provide a toy that is able to make character movement realistic.

In order to achieve the above object, the present invention constitutes a toy comprising a structural body that constitutes a physical space which has depth and is open at the front; a transparent LCD screen that is disposed in a position that is visible from the front in the vicinity of the front or within the space; a physical object, such as a furniture, an in-house structure or an interior, that is physically disposed in the space at the front or rear of the LCD screen; and display means for displaying a character, an image such as of a girl or a dog, on the LCD screen and programmed such that image of the character moves virtually in association with the physical object.

When the toy is constituted, the following elements can be added.

(1) The structural body is a miniature house of the toy, the space is a room of the house, the object is an internal body such as a miniature table or chair that is disposed in the room, and the image of the character is programmed to virtually move on the LCD screen at the rear portion or front portion of the internal body. (2) The structural body is a house of the toy, the space is a room of the house, the object is an internal body such as a table or chair that is disposed in the room or an external body such as a miniature tree, fence or kennel physically disposed at the front of the house, and the character is programmed to virtually move the rear portion of the external body and the front portion of the internal body.

Further, the present invention is a toy house, wherein the house constitutes a room space open at the front, and comprises a transparent LCD screen that is provided in contact with the left and right walls, ceiling and floor of the room and disposed in a position that is visible from the front; an internal body that is disposed on both sides of the front and rear portions of the LCD screen; and display means for displaying a character on the LCD screen and programmed such that the character moves virtually in association with the internal body.

When the house of the toy is constituted, the following elements can be added.

(1) The internal body is steps or stairs that are disposed at the rear of the LCD screen and the display means is programmed such that the character virtually moves up and down the stairs.

(2) The internal body is a table disposed at the front of the LCD screen and the display means is programmed such that the character moves to sit in front of the table.

(3) The internal body is a table and a chair arranged with the LCD screen interposed therebetween and the display means is programmed such that the character moves to sit on the chair in front of the table.

Further, the present invention is a toy house, wherein the house constitutes a room space open at the front, and comprises a transparent LCD screen that is provided in contact with the left and right walls, ceiling and floor of the room and disposed in a position that is visible from the front; an external body such as a tree, fence or kennel that is disposed at the front of the LCD screen and an internal body that is disposed at the rear of the LCD screen; and display means for displaying a character on the LCD screen and programmed such that the character moves virtually in association with the external body or internal body.

In addition, the present invention is a toy house, comprising an LCD screen that is disposed in a space inside the house; and display means for displaying a moving character on the LCD screen, wherein the toy house is constituted such that another house can be connected next to the house, and the display means is programmed such that, when the other house is connected in parallel, the moving character virtually moves from one house to the other house.

With the above means, a transparent LCD screen is disposed in a structural body constituting the house of the toy, an internal body and external body and so forth are disposed at the front and rear of the LCD screen and a character is displayed on the LCD screen. Therefore, the movement of the character can be made realistic.

According to the present invention, the movements of the character can be made realistic and the player can be provided with play that is of a higher quality.

DETAILED DESCRIPTION

Figure 1A:
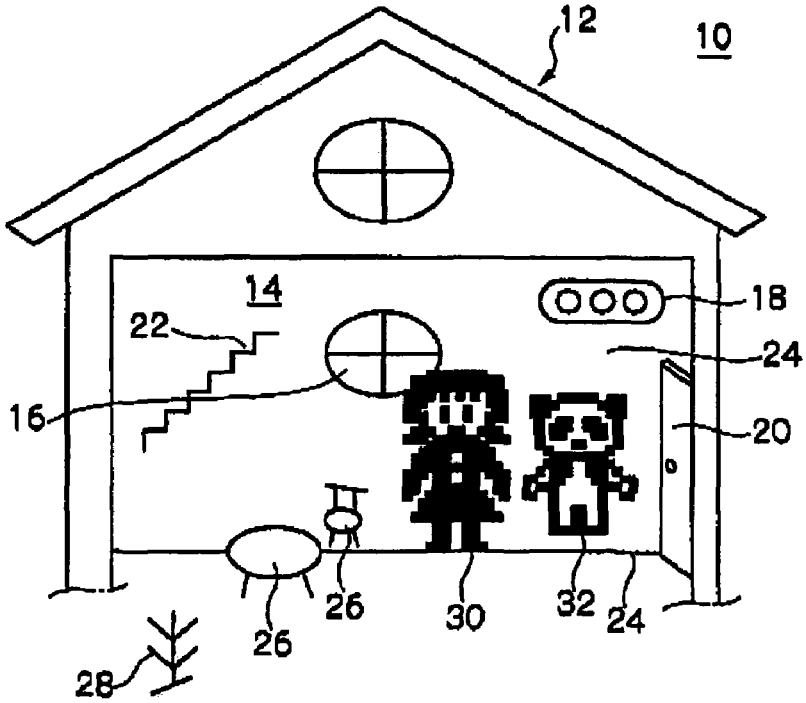
FIG. 1*a* is an explanatory front view of a toy showing a first embodiment of the present invention.
Figure 2:
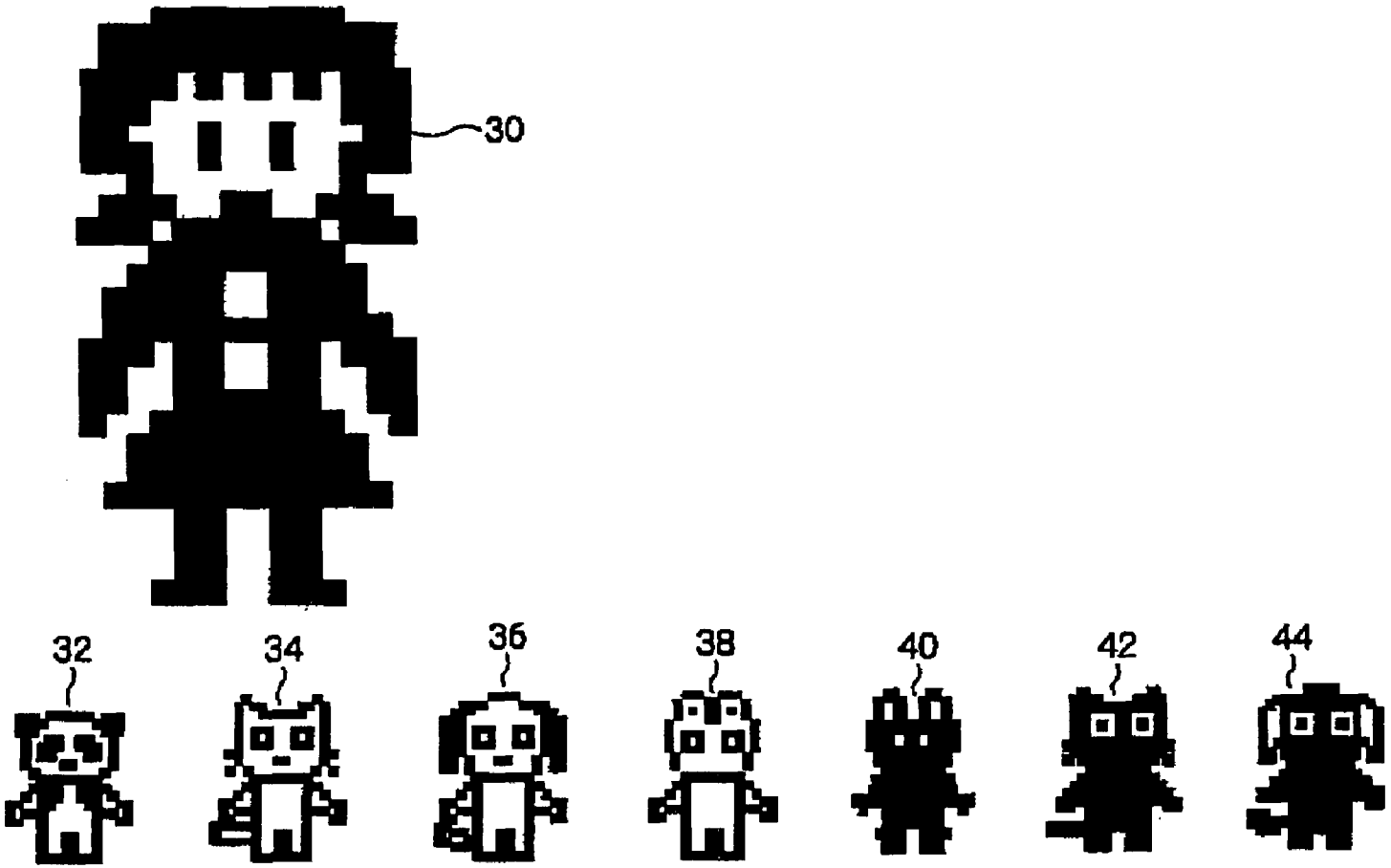
FIG. 2 is a front view of a variety of characters.

An embodiment of the present invention will be described hereinbelow with reference to the drawings. FIG. 1*a* is an explanatory front view of a toy showing the first embodiment of the present invention. In FIG. 1*a*, a toy 10 comprises a house (doll's house) 12 as a structural body constituting a space that has depth and is open at the front. The house 12 is provided with a room 14 that constitutes a wide space on the first floor of a two-story building, a window 16 is provided at the back of the room 14, a liquid crystal dock 18 is disposed above and to the right of the window 16, a door 20 is provided in the right-hand corner of the room 14, and stairs 22 that lead to the second floor are provided in the left corner of the room 14. A transparent LCD (liquid-crystal display) screen 24 that can be viewed from the front of the room 14 is disposed in the room 14, and a speaker and computer system and so forth are arranged on the rear side of the room 14. The transparent LCD screen 24 is formed in a substantially rectangular shape and is provided in contact with the left and right walls, ceiling, and floor respectively. A variety of objects are arranged at the front and rear of the transparent LCD screen 24. For example, internal bodies 26 such as a chair and a table are arranged inside the room 14 with the LCD screen 24 interposed therebetween (the chair at the rear side of the LCD screen and the table at the front side of the LCD screen), and an external body 28 such as a tree, fence, or kennel is disposed at the front of the house 12. The transparent LCD screen 24 comprises a plurality of cells of liquid crystals each constituting a pixel and a variety of characters such as a girl character 30 and an animal character 32. Samples of various animal characters 32 to 44 to be displayed on the transparent LCD screen 24 are shown in FIG. 2.

Figure 1B:
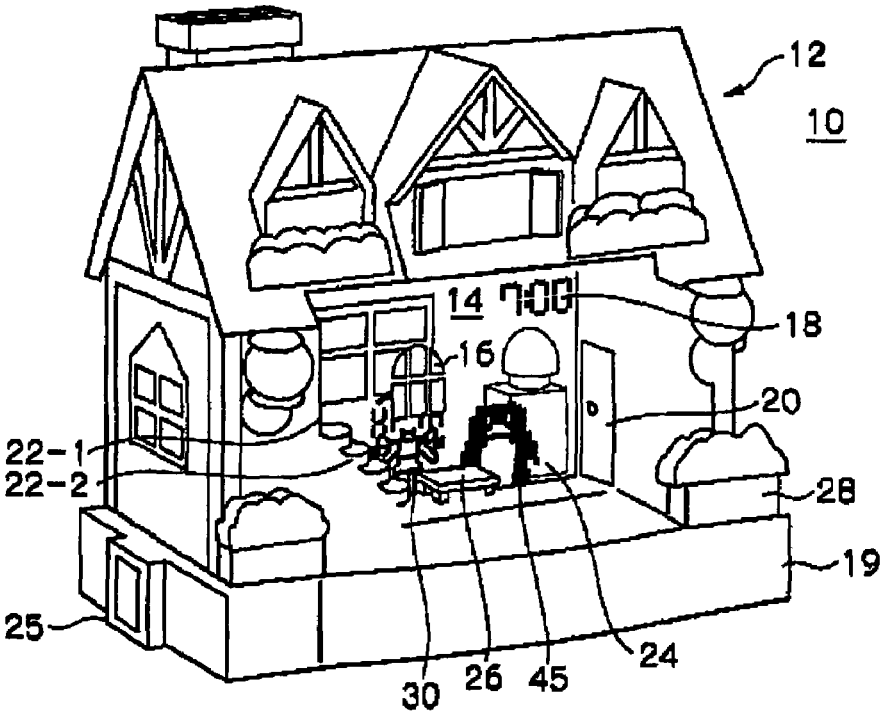
FIG. 1*b* is a perspective view of the toy showing the first embodiment of the present invention.

FIG. 1*b* is a perspective view of the toy house 12. In FIG. 1*b* the toy house is depicted more in details. The LCD screen 24 is located at the middle in the room 14 so that the edges of the LCD screen are in contact with, and fixed to, the left and right walls, ceiling and floor. The miniature table 26 is positioned at, and in contact with, the front side of the LED screen. The lower stairs 22-2 are positioned along the front side of the LED screen and the upper stairs 22-1 are positioned at the rear side of the LCD screen. On the screen 24 are displayed as an example a girl character 30 and another animal character 45 different from the animal characters shown in FIG. 2. In front of the house exterior objects 28, for example, fences 28 may be disposed. The clock 18 is installed on the LCD screen 24.

A rest member 19 has two connectors 25, one at its left side and another at its right side (not shown). These connectors provide communication lines as will be explained in detail hereinafter in a further embodiment depicted with FIG. 4.

Figure 3:
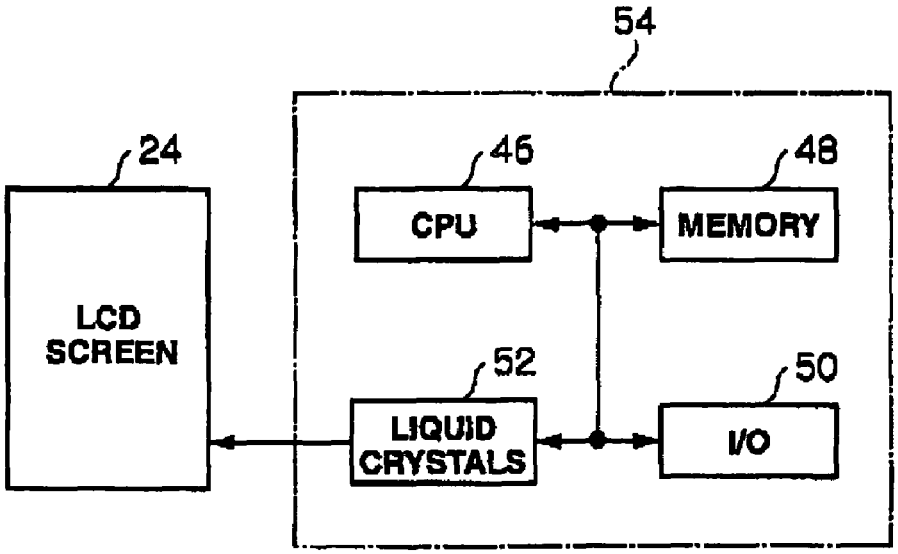
FIG. 3 is a constitutional view of a microcomputer.

A variety of images of the characters 30 to 45 move virtually on the LCD screen in association with a variety of physical objects disposed in the room 14 by means of the display means. The display means is one element of a computer system and is constituted by a microcomputer 54 comprising a CPU46, memory 48, I/O interface 50, and a liquid-crystal drive circuit 52, and so forth, as shown in FIG. 3, for example. A storage medium such as a ROM, an SRAM, and an EEPROM, for example, may be employed as the memory 48 for storing computer programs and image data for displaying the images of the characters and for controlling the movement of the characters. The CPU 46 further executes computation processing to cause a game to progress in accordance with a program (game program) that is stored in the memory 48, thus displaying each of the characters 30 to 44 and so forth on the transparent LCD screen 24 in accordance with Fe computation results.

The microcomputer 54 is programmed as display means such that various objects and so forth move virtually in association with the characters 30 to 44, for example. More specifically, the microcomputer 54 is programmed such that the characters 30 to 44 virtually move the front or rear portion of the internal body 26 and virtually move the rear portion of the external body 26. Further, the microcomputer 54 is programmed such that the internal body 26 and external body 28 move virtually in association with each other, the characters 30 to 44 virtually move up and down the stairas (internal body) 22 that are disposed at the rear of the transparent LCD screen 24 (in the embodiment depicted in FIG. 1*b*, lower stairs 22-2 are disposed at the front of the LCD screen and upper stairs 22-1 at the rear), and programmed such that the characters 30 to 45 move to sit in front of the table and the characters 30 to 44 move to sit on a chair in front of the table. Furthermore, the microcomputer 54 is programmed such that, when the house 12 is connected via a communication line to another adjacent house, the characters 30 to 44 virtually move from the house 12 to the other house.

Character 30 is created as a protagonist girl and the animal characters 32 to 44 are created as friends of the protagonist character 30 to be capable of walking on two feet and living in the same way as people. Three types of the animal characters 32 to 44 are prepared in one house 12 and one of the animals is randomly created (programmed) to live with the protagonist character 30. In addition, the character 30 and so forth are programmed with a variety of functions.

For example, by manipulating a switch on the front of the house 12, the user (player) is able to give a meal to the protagonist, put the television on, and allow a little mischief. Further, when the user strikes (knocks) the roof of the house 12, the outside of the window 16 lights up in accordance with the time of the liquid crystal clock 18 (32 dots high×64 dots wide) and, normally (during the daytime), the character 30, which moves automatically, goes up the steps 22 to the bathroom on the second floor and takes a bath and, depending on the time, goes to bed in the bedroom. When the character 30 enters the bathroom on the second floor, a sound like 'Zal' is emitted from the speaker.

When the user strikes the roof of the house 12, a daytime pattern includes a 'morning greeting', 'breakfast', 'leaving the house', 'cleaning', 'washing', 'television', 'lunch', and 'express home delivery' and an evening/night pattern includes 'dinner', 'washing', 'bath' 'toilet', 'toothpaste', 'sitting in a circle', 'getting ready for bed', and 'nighttime greeting' additionally as revolving patterns.

Furthermore, when the user sets the time by resetting the liquid crystal clock 18, the set time is displayed, the protagonist character 30 appears based on the time thus set and then the door 20 of the house 12 opens and any one of the animal characters 32 to 44 randomly appears as a room mate to live with the character 30 (the animal characters 32 to 44 also sometimes do not appear).

Further, the lives of the protagonist character 30 and animal characters 32 to 44 change on a daily basis and the protagonist character 30 and animal characters 32 to 44 occasionally also dance as a pair. However, depending on the behavior of the protagonist character 30, the animal characters 32 to 44 rush out of the house 12 or become sick. Further, even when nothing happens, as time elapses, before long a harmonious separation between the protagonist character 30 and the animal character 32 to 44 takes place and a new animal character 32 to 44 appears instead. In addition, the house 12 can be connected via a communication line to two to three other houses that are connected, and, when the house 12 is connected to another adjacent house, the animal characters of the other house come to the house 12 and play for a while. Further, the animal characters go to and fro between the house 12 and the other house via the communication line, animal characters dance, and enjoyable events are initiated.

Such events include, for example, 'partner animal characters receive a meal as a present', 'partner animal characters dance together', 'one's own animal character is kidnapped', 'quarrel starts between animal characters' and 'animal characters hit it off and leave as a couple', and so forth.

Figure 4:
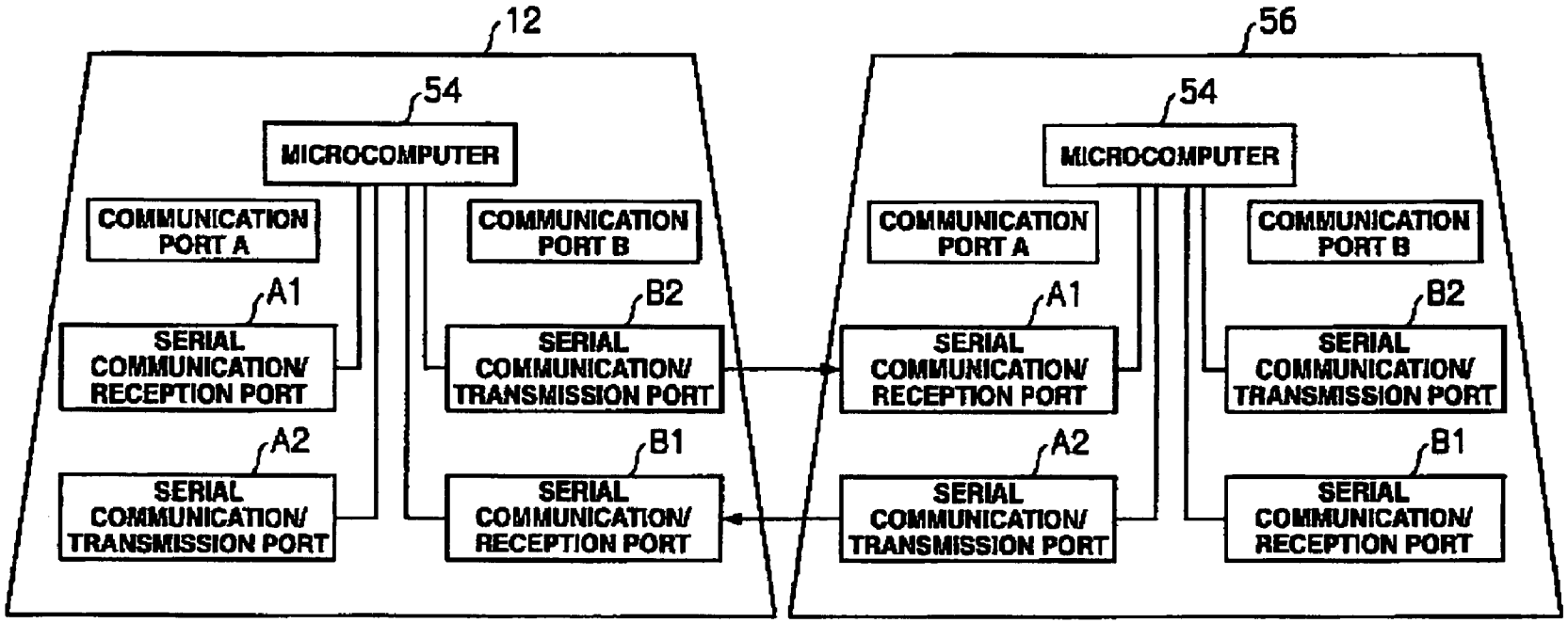
FIG. 4 is an explanatory view of the constitution when two houses are connected by a communication line.

When the house 12 and another house are connected via a communication line, each house is provided with communication ports A and B as communication means, as shown in FIG. 4. Each communication port is provided with serial communication reception ports A1 and B1 and serial transmission ports A2 and B2.

Here, when communication ports B of the house 12 and communication ports A of another house 56 are connected via a communication line, communication lines are not connected to the communication ports A of the house 12. Therefore, the communication ports B of the house 12 are master devices (highest order addresses), whereas, in the other house 56, communication lines are not connected to the communication ports B which are therefore slave devices (lowest order addresses). If the addresses of the communication ports of the houses 12 and 56 respectively are determined, it is determined which devices at which addresses to send data to, whereby mutual communication is permitted. That is, by using communication ports B (communication ports B1 and B2) from the house 12 to transmit the addresses of the house 12 to the communication ports A of the other house 56, mutual communication is then permitted. In this case, information and the like relating to the movements of the animal characters 32 to 44 is communicated between the house 12 and other house 56.

When the switch of the house 12 is thrown by the user upon using the toy 10 thus constituted, the microcomputer 54 starts up and the game develops in accordance with the program. For example, when the users sets the time by resetting the liquid crystal clock 18, the time thus set is displayed and the protagonist character 30 appears based on the time thus set, whereupon the door 20 of the house 12 opens, and any one of the animal characters 32 to 44 randomly appears as a room mate to live with the protagonist character 30. The life of any one of the protagonist character 30 and animal characters 32 to 44 changes on a daily basis and the protagonist character 30 and animal characters 32 to 44 occasionally also dance as a pair. However, depending on the behavior of the protagonist character 30, the animal characters 32 to 44 rush out of the house 12 or become sick. Further, even when nothing happens, as time elapses, before long a harmonious separation between the protagonist character 30 and the animal character 32 to 44 takes place and a new animal character 32 to 44 appears instead.

On the other hand, when the user strikes (knocks) the roof of the house 12, the outside of the window 16 lights up in accordance with the time of the liquid crystal clock 18 and the character 30 goes up the steps 22 to the bathroom on the second floor and takes a bath. When the character 30 enters the bathroom on the second floor, a sound like 'Zal' is emitted from the speaker.

In the process in which the game or stories of a preset scenario develops, the character 30 or the like is displayed on the LCD screen 24 that is disposed in the room 14 of the house 12. Therefore, the user is able to enjoy the game or stories of a preset scenario while viewing the character 30 on the LCD screen 24, the internal body 26 and the external body 28, the movements of the character 30 can be made realistic and the user can be provided with play of a higher quality.

We claim:

1. A toy comprising:

a miniature structural body that provides a physical internal space which is open at the front of said structural body so that a viewer located outside of the structural body can look into the internal space;

a transparent LCD (Liquid Crystal Display) screen that is disposed in said structural body in the vicinity of the open front or within the internal space;

a first miniature object disposed physically in front of the LCD screen;

a second miniature object disposed physically in said internal space of the structural body behind the LCD screen so that the viewer can view the second object through said transparent LCD screen; and image generator means configured to display an image of a virtual character on the transparent LCD screen and programmed to move the image of the character on the LCD screen such that the character virtually performs actions in association with the first and the second miniature objects, wherein the viewer can see the virtual character performing actions in said internal space in association with the first and the second miniature objects.

2. The toy according to claim 1, wherein the structural body is a miniature house of the toy, the internal space is a living room for the virtual character, wherein said first and second miniature objects include a miniature furniture physically disposed in the room and an internal structure of the room.

3. The toy according to claim 2, further comprising a miniature external object externally disposed in front of the miniature house, wherein the character is programmed to virtually move behind the external object.

4. A toy house comprising:

a miniature house-shaped structure;

a room space provided in the house-shaped structure which is open at the front of the room space so that a viewer located outside of the toy house can look into the room space;

a transparent plate formed of a liquid crystal display, said transparent plate being arranged in said room space so that the edges of the transparent plate are in contact with the left and right walls, ceiling and floor of the room, and disposed in a position so that the viewer can look into the room space behind the transparent plate from the front of the toy house;

a first miniature internal body disposed in front of the transparent plate;

a second miniature internal body disposed behind the transparent plate so that the viewer can see the second miniature internal body through the transparent plate; and image generator means configured to display an image of a character on the transparent plate of the liquid crystal display and programmed to move the image of the character on the transparent plate such that the character virtually performs actions in association with the first and second miniature internal bodies.

wherein the viewer can see the virtual character performing actions in said room space in association with the first and second miniature internal bodies.

5. The toy house according to claim 4, wherein the said second miniature internal body is stairs that are disposed behind said transparent plate of the liquid crystal display, wherein the image of the character is programmed such that the character virtually moves up and down the stairs.

6. The toy house according to claim 4, wherein said first miniature internal body is a miniature table disposed in front of said transparent plate of the liquid crystal display, wherein the image of the character is programmed such that the character moves to sit in front of the table.

7. The toy house according to claim 4, wherein said first internal body is a miniature table located in front of the transparent plate and said second internal body is a miniature chair located behind the transparent plate, wherein the image of the character is programmed such that the character moves to sit on the chair in front of the table.

8. A toy house, comprising:

a miniature house-shaped structure;

a miniature room space provided in the toy house-shaped structure which is open at the front of the room space so that a viewer located outside of the toy house can look into the room space;

a transparent plate of a liquid crystal display provided in said room space so that the edges of the transparent plate are in contact with the left and right walls, and with the ceiling and floor of the room, said transparent plate being disposed in a position so that the viewer can look into the room space behind the transparent plate from the front of the toy house;

an external miniature body disposed outside of the room space; and an internal miniature body disposed in the room space behind the transparent plate of the liquid crystal display so that the viewer can see the internal miniature body through the transparent plate; and image generator means configured to display an image of a character on the liquid crystal display and programmed to move the image of the character such that character virtually performs actions in association with the external miniature body or the internal miniature body, wherein the viewer can see the virtual image character performing actions in said room space in association with the external miniature body or the internal miniature body.

9. A toy house assembly set comprising:

a pair or miniature houses detachably connectable side by side with each other, each having an internal space and provided with an LCD screen that is disposed in the internal space inside the house, image generation means configured to display a character on the LCD screen, said character moving in said space inside the house, and electrical connectors providing communication lines between the miniature houses when connected, wherein said internal space as well as the LCD screen in each of the miniature houses is configured such that a viewer located outside of the miniature houses can look into the internal space and the LCD screen, wherein the toy house assembly set is programmed such that, when each of the pair of the houses is connected side by side so as to establish the connection lines therebetween, the character displayed on the LCD screen in one of the miniature houses moves onto the LCD screen in the other of the miniature houses wherein the character virtually moves from one house to the other house.

* * * * *